US009802806B2

(12) United States Patent
Hewitt et al.

(10) Patent No.: US 9,802,806 B2
(45) Date of Patent: Oct. 31, 2017

(54) APPARATUS FOR DISPENSING A FLUID FROM A CONTAINER AND REGULATING A TEMPERATURE THEREOF

(71) Applicant: HEWY WINE CHILLERS, LLC, Orlando, FL (US)

(72) Inventors: Benjamin R. Hewitt, Orlando, FL (US); Roy Paul Prosise, Cedar Park, TX (US)

(73) Assignee: HEWY WINE CHILLERS, LLC, Orlando, FL (US)

( * ) Notice: Subject to any disclaimer, the term of this patent is extended or adjusted under 35 U.S.C. 154(b) by 100 days.

(21) Appl. No.: 14/758,618

(22) PCT Filed: Jun. 10, 2013

(86) PCT No.: PCT/US2013/044958
§ 371 (c)(1),
(2) Date: Jun. 30, 2015

(87) PCT Pub. No.: WO2014/107187
PCT Pub. Date: Jul. 10, 2014

(65) Prior Publication Data

US 2015/0360926 A1 Dec. 17, 2015

Related U.S. Application Data

(60) Provisional application No. 61/748,848, filed on Jan. 4, 2013.

(51) Int. Cl.
*B67D 7/80* (2010.01)
*B67D 3/00* (2006.01)
(Continued)

(52) U.S. Cl.
CPC ..... *B67D 3/0009* (2013.01); *B65D 1/023* (2013.01); *B65D 25/48* (2013.01); *B65D 81/18* (2013.01);
(Continued)

(58) Field of Classification Search
CPC ..... B67D 3/0009; B65D 1/023; B65D 81/18
(Continued)

(56) References Cited

U.S. PATENT DOCUMENTS 298,694 A 5/1884 Jewett
528,463 A 10/1894 Busch
(Continued)

FOREIGN PATENT DOCUMENTS

CN 2852868 Y 1/2007
CN 1918049 A 2/2007
(Continued)

OTHER PUBLICATIONS

PCT/US2014/010069; International Search Report dated May 7, 2014.
(Continued)

*Primary Examiner* — Patrick M Buechner
*Assistant Examiner* — Jeremy W Carroll

(57) ABSTRACT

An apparatus regulates a temperature of a fluid inside a container and dispenses the fluid from the container. The apparatus has a body with an axis, a cavity adjacent a distal end, a bore adjacent a proximal end, and a fluid inlet formed through the body to the bore. The body contacts the fluid inside the container. A second fluid may be located and sealed inside the cavity, and have a freezing point of about 10° C. or less. A nozzle may be mounted to the body. The nozzle has a channel in communication with the fluid inlet through which the fluid flows out of the container through the nozzle. A seal may be mounted to the body. The seal may
(Continued)

have a radial seal to seal radially between the body and an interior of the container, and an axial seal to seal axially between the nozzle and the container.

19 Claims, 5 Drawing Sheets

(51) Int. Cl.

| | |
|---|---|
| ***F25D 3/08*** | (2006.01) |
| ***B65D 1/02*** | (2006.01) |
| ***B65D 25/48*** | (2006.01) |
| ***B65D 81/18*** | (2006.01) |
| *B65D 47/06* | (2006.01) |

(52) U.S. Cl.
CPC ..... *B67D 3/0067* (2013.01); *F25D 3/08* (2013.01); *B65D 47/06* (2013.01); *F25D 2303/0842* (2013.01); *F25D 2331/803* (2013.01)

(58) Field of Classification Search
USPC ..... 222/146.6, 130, 131, 190
See application file for complete search history.

(56) References Cited

U.S. PATENT DOCUMENTS

| | | | | |
|---|---|---|---|---|
| D30,832 | S | 5/1899 | Lowrey | |
| D30,833 | S | 5/1899 | Lowrey | |
| 1,030,325 | A | 6/1912 | Peoples et al. | |
| D92,580 | S | 6/1934 | Caplan | |
| D101,785 | S | 11/1936 | Liebeshutz | |
| 2,164,314 | A | 7/1939 | Edwards | |
| D122,941 | S | 10/1940 | Grunberg | |
| D135,105 | S | 2/1943 | Moran | |
| 2,669,370 | A | 2/1954 | Royall | |
| 2,734,358 | A | 2/1956 | Himmelfarb | |
| 2,746,265 | A * | 5/1956 | Mills | B65D 51/24 62/293 |
| 2,749,719 | A | 6/1956 | Copeman | |
| 3,059,452 | A | 10/1962 | Griffin | |
| 3,147,888 | A | 9/1964 | Mooney | |
| 3,161,031 | A | 12/1964 | Flannery | |
| 3,241,724 | A | 3/1966 | Lerner | |
| 3,320,767 | A | 5/1967 | Whalen | |
| D224,748 | S | 9/1972 | Daher | |
| 4,402,195 | A | 9/1983 | Campbell | |
| 4,478,346 | A | 10/1984 | Spong | |
| 4,531,383 | A | 7/1985 | Zimmermann | |
| 4,599,872 | A | 7/1986 | Rist | |
| 4,702,396 | A | 10/1987 | Gwiazda | |
| 4,735,063 | A * | 4/1988 | Brown | F25D 3/107 62/293 |
| 4,823,974 | A | 4/1989 | Crosser | |
| 4,981,022 | A | 1/1991 | Snyder | |
| 4,993,237 | A | 2/1991 | Bond | |
| 5,009,083 | A | 4/1991 | Spinos | |
| D317,543 | S | 6/1991 | Small | |
| D318,009 | S | 7/1991 | Litton | |
| 5,031,831 | A | 7/1991 | Williams | |
| 5,129,238 | A | 7/1992 | Schwartz et al. | |
| D339,955 | S | 10/1993 | Katz | |
| 5,456,090 | A * | 10/1995 | McCoy | A61J 9/00 165/80.5 |
| 5,467,877 | A | 11/1995 | Smith | |
| 5,472,274 | A * | 12/1995 | Baillie | A47G 19/12 222/146.6 |
| 5,502,981 | A | 4/1996 | Sullivan | |
| D371,269 | S | 7/1996 | Shattuck et al. | |
| D380,677 | S | 7/1997 | Joergensen | |
| 5,651,254 | A | 7/1997 | Berry | |
| 5,732,567 | A | 3/1998 | Anderson | |
| D401,697 | S | 11/1998 | Cloonan et al. | |
| D404,647 | S | 1/1999 | Federighi | |
| 5,881,868 | A | 3/1999 | Soyak et al. | |
| 5,897,037 | A | 4/1999 | Mann | |
| D420,253 | S | 2/2000 | Malusek | |
| 6,103,280 | A | 8/2000 | Molzahn et al. | |
| 6,196,017 | B1 | 3/2001 | Chapman | |
| 6,324,864 | B1 | 12/2001 | Stewart et al. | |
| D459,227 | S | 6/2002 | Liebmann, Jr. | |
| 6,494,056 | B1 | 12/2002 | Roth et al. | |
| 6,584,800 | B1 | 7/2003 | Roth et al. | |
| D478,511 | S | 8/2003 | Reynolds | |
| 6,622,516 | B1 | 9/2003 | Horen | |
| 6,658,859 | B2 | 12/2003 | Phelps et al. | |
| 6,751,982 | B2 | 6/2004 | Horen | |
| D499,023 | S | 11/2004 | Amos | |
| 6,889,945 | B2 | 5/2005 | McCall | |
| D511,995 | S | 11/2005 | Pettis, III | |
| 7,069,739 | B2 | 7/2006 | Porter | |
| 7,082,784 | B2 | 8/2006 | Roth et al. | |
| 7,185,782 | B2 | 3/2007 | Vilchez, Jr. et al. | |
| 7,299,936 | B2 | 11/2007 | Singh et al. | |
| D559,870 | S | 1/2008 | Conlon, Jr. et al. | |
| D596,440 | S | 7/2009 | Rothenberg | |
| D596,944 | S | 7/2009 | Mueller et al. | |
| D602,355 | S | 10/2009 | Waaland | |
| 7,614,512 | B2 | 11/2009 | Nader | |
| 7,614,513 | B2 * | 11/2009 | Anderson | B65D 81/3216 215/10 |
| D621,660 | S | 8/2010 | Smiedt et al. | |
| 7,802,446 | B2 | 9/2010 | Overgaard | |
| 7,810,348 | B2 * | 10/2010 | Shewchuk | F25D 3/08 62/457.1 |
| D631,285 | S | 1/2011 | Smiedt | |
| D632,571 | S | 2/2011 | Blythe | |
| D633,753 | S | 3/2011 | White | |
| D634,158 | S | 3/2011 | Roth et al. | |
| 7,997,099 | B2 | 8/2011 | Roth et al. | |
| 8,042,356 | B2 | 10/2011 | Norris et al. | |
| 8,051,674 | B2 | 11/2011 | Roth et al. | |
| 8,061,158 | B2 * | 11/2011 | Roth | F25D 3/08 62/457.3 |
| 8,066,152 | B2 | 11/2011 | Tetreault et al. | |
| 8,069,860 | B2 | 12/2011 | Soyak et al. | |
| D660,077 | S | 5/2012 | Burns | |
| 8,172,454 | B2 | 5/2012 | Choi | |
| D682,691 | S | 5/2013 | Hewitt et al. | |
| 2002/0005044 | A1 | 1/2002 | Mahajan | |
| 2003/0196448 | A1 | 10/2003 | Roth et al. | |
| 2004/0123620 | A1 * | 7/2004 | Porter | F25D 31/007 62/457.3 |
| 2005/0252234 | A1 | 11/2005 | Kim | |
| 2006/0010903 | A1 | 1/2006 | Porter | |
| 2006/0162374 | A1 * | 7/2006 | Ganser | A47G 23/04 62/457.4 |
| 2007/0090205 | A1 | 4/2007 | Kunze et al. | |
| 2007/0147469 | A1 | 6/2007 | Harris | |
| 2008/0282907 | A1 | 11/2008 | Begin et al. | |
| 2008/0290062 | A1 | 11/2008 | Luzaich et al. | |
| 2009/0212071 | A1 | 8/2009 | Tom | |
| 2010/0202244 | A1 * | 8/2010 | Choi | A47J 43/0727 366/144 |
| 2011/0042418 | A1 | 2/2011 | Lambrecht | |
| 2011/0108506 | A1 | 5/2011 | Lindhorst-Ko | |
| 2011/0114218 | A1 | 5/2011 | Overgaard | |
| 2011/0204093 | A1 | 8/2011 | Lee | |
| 2012/0074172 | A1 | 3/2012 | Federighi | |
| 2012/0111893 | A1 | 5/2012 | Luebke | |
| 2012/0266625 | A1 | 10/2012 | Hewitt et al. | |

FOREIGN PATENT DOCUMENTS

| | | | |
|---|---|---|---|
| CN | 201264748 | Y | 7/2009 |
| DE | 10037433 | A1 | 8/2001 |
| DE | 20303040 | U1 | 4/2004 |
| EP | 1450118 | A2 | 8/2004 |
| EP | 1985951 | A1 | 10/2008 |
| FR | 2736894 | A1 | 1/1997 |
| FR | 2805337 | A1 | 8/2001 |

(56) References Cited

FOREIGN PATENT DOCUMENTS

| | | | |
|---|---|---|---|
| GB | 2340591 | A | 2/2000 |
| JP | 2001048244 | A1 | 2/2001 |
| WO | 2014/107508 | A1 | 7/2014 |

OTHER PUBLICATIONS

PCT/US2012/034016 International Search Report dated Nov. 29, 2012.
Propylene Glycol bases heat-transfer Fluids, The Engineering Toolbox, www.engineeringtoolbox.com Sep. 15, 2010, accessed through archive.org/web Apr. 16, 2014.
Chef Todd English Will Launch The Todd English Collection ™ on HSN and HSN.Com on Nov. 7 and 8.
Corkcicle Wine Chiller, kitchenboy , by KitchenBoy (http://kitchenboy.net/blog/author/administrator/), Aug. 17, 2012.
Wine Sceptre, youtube, Mar. 2, 18, 2010, YouTube, http://www.youtube.com/watch?v=Qt58q8jdp08.
CB Peoples & AE Yelton, Milk Can, 3 of 3, Jun. 25, 1912, USPTO Washington DC.
LG Royal Jr, Rubber Stopper, 3 of 3, Jul. 28, 1950 USPTO Washington DC.
PCT/US2013/044958; International Search Report dated Nov. 2, 2013.
Matsuri Sake Set by Roost, Oprah.com.
Extended European Search Report dated Aug. 4, 2016, with regard to European Application No. 1473512.7.
Supplementary Partial European Search Report dated Oct. 12, 2016 in connection with European Patent Application No. EP 13 86 9988.

* cited by examiner

APPARATUS FOR DISPENSING A FLUID FROM A CONTAINER AND REGULATING A TEMPERATURE THEREOF

BACKGROUND OF THE INVENTION

Field of the Disclosure

The present invention relates in general to regulating the temperature of a fluid in a container and, in particular, to an apparatus for regulating the temperature of a fluid in a bottle, and dispensing it through the apparatus.

Description of the Related Art

The temperature at which some beverages are served is important to appreciate their special qualities and flavors. There are various authorities that suggest the ideal temperature ranges for each type of beverage. The temperature ranges vary greatly according to the type of beverage. For example, a wide temperature range exists between the desired temperatures associated with different types of beer, as well as red wines and white wines.

There are several factors that make it challenging to maintain the ideal temperature that allows a beverage to reveal all of its qualities. One factor concerns the conditions in which the bottles are kept after they are opened. This can lead to a serving temperature that is either too high or too low after the bottle is selected, opened and served. It is difficult to keep bottles within satisfactory temperature conditions, as they will more often than not become too warm when left on a table at room temperature, or become too cold if put on ice. Once removed from a proper cooling environment, keeping a chilled beverage at a temperature below ambient temperature is particularly difficult.

There also is some risk of the beverage losing its flavors and taste by bringing about a decrease in temperature that occurs too quickly. For example, use of an ice bucket or freezer may cause this destructive effect on the qualities of the beverage. In some businesses, such as restaurants and catering, this process needs to be done quickly and cannot be avoided. It is rarely possible for some servers to ask a customer to wait to taste the vintage chosen on a list. It is also undesirable to risk being discredited by serving a beverage that is at the wrong temperature. It is therefore desirable to facilitate bringing and maintaining drinks at an ideal temperature to savor it without necessarily affecting its qualities.

Various solutions have been proposed to maintain the desired beverage serving temperature in conditions that reduce risk to affecting its taste. Again, ice buckets are a common choice for this proposition and there are many different types. Other solutions are inserted into a bottle and incorporate pour-through apertures such that their apparatus is not removed from the bottle until it is empty. Moreover, conventional pour-through devices may enable excessive ventilation of the beverage which increases beverage temperature and affects its taste. Thus, improvements in regulating the temperature of beverages would be desirable.

SUMMARY

Embodiments of an apparatus for regulating a temperature of a fluid inside a container, and dispensing the fluid from the container are disclosed. The apparatus has a body that may have an axis, a cavity adjacent a distal end, a bore adjacent a proximal end, a fluid inlet formed through the body to the bore, and the body is adapted to contact the fluid inside the container. A second fluid may be located and sealed inside the cavity, the second fluid having a freezing point of about 10° C. or less. A nozzle may be mounted to the body. The nozzle may have a channel in communication with the fluid inlet through which the fluid is adapted to flow out of the container through the nozzle. A seal may bee mounted to the body. The seal may have a radial seal adapted to seal radially between the body and an interior of the container, and an axial seal adapted to seal axially between the nozzle and the container.

Other embodiments of an apparatus for regulating a temperature of fluid in a container may comprise a body having an axis, a proximal end, a distal end, a cavity inside the body, an elongated shape in an axial direction, and a series of radial bulges axially spaced apart from each other. A fluid may be sealed in the cavity and having a freezing point below about 10° C. An assembly may be mounted adjacent the proximal end of the body. The assembly may have a radial seal adapted to seal an opening in the container of fluid, and a channel that is completely unobstructed without a closure and adapted to dispense fluid therethrough from the container.

Still other embodiments of an apparatus for regulating a temperature of a fluid in a bottle may comprise a body having an axis, a proximal end, a distal end, a cavity inside the body, the body being elongated in an axial direction such that an exterior of the body is generally tapered axially for a substantially entire axial length thereof. A fluid may be sealed in the cavity and having a freezing point below about 10° C. An assembly may be mounted adjacent the proximal end of the body, an exterior of the assembly is adapted to seal the bottle of fluid, and an interior of the assembly is adapted to dispense fluid therethrough without an aerator.

The foregoing and other objects and advantages of these embodiments will be apparent to those of ordinary skill in the art in view of the following detailed description, taken in conjunction with the appended claims and the accompanying drawings.

BRIEF DESCRIPTION OF THE DRAWINGS

So that the manner in which the features and advantages of the embodiments are attained and can be understood in more detail, a more particular description may be had by reference to the embodiments thereof that are illustrated in the appended drawings. However, the drawings illustrate only some embodiments and therefore are not to be considered limiting in scope as there may be other equally effective embodiments.

The use of the same reference symbols in different drawings indicates similar or identical items.

DETAILED DESCRIPTION

Figure 1:
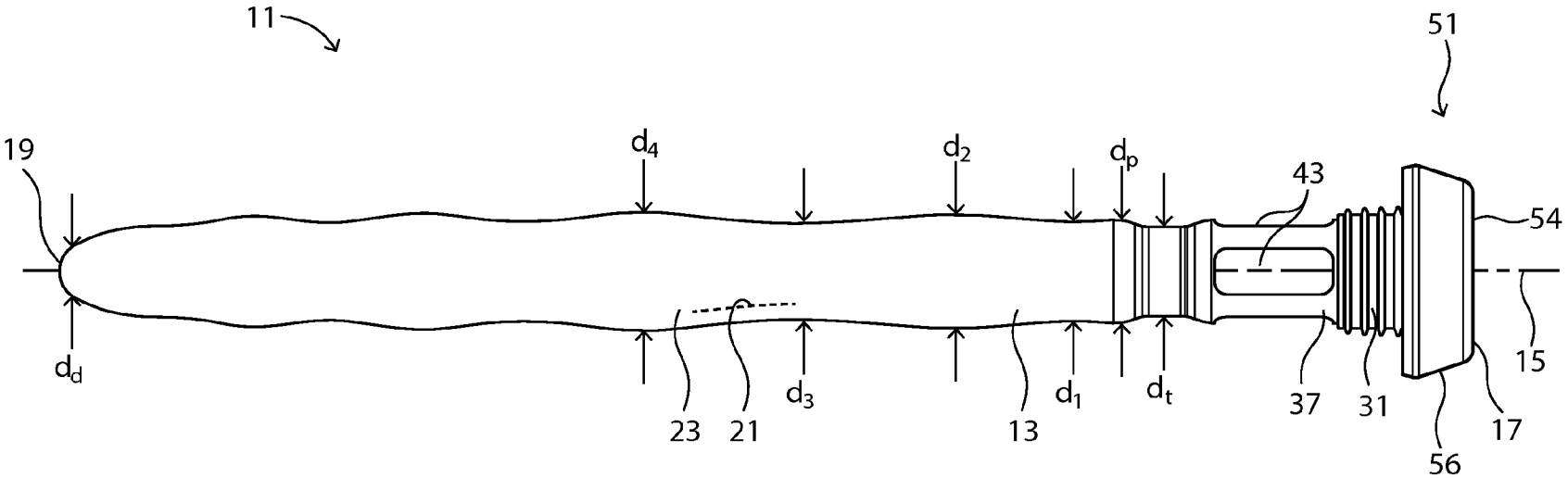
FIGS. 1 and 2 are side (partially sectioned) and enlarged isometric views, respectively, of an embodiment of an apparatus.

Embodiments of an apparatus for maintaining the temperature of a fluid and dispensing the fluid from a container are disclosed. As shown in FIG. 1, the apparatus 11 may comprise a body 13 having a longitudinal axis 15, a proximal end 17, and a distal end 19. In some examples, the body 13 may be formed from a metallic material such as stainless steel, aluminum, copper, alloys thereof, etc., which may be opaque. In other embodiments, a plastic material such as a translucent or transparent ethylene-based copolymer, polymeric blends of ethylene-methacrylic acid copolymers and polyethylene, etc., may be used for the body.

Figure 3:
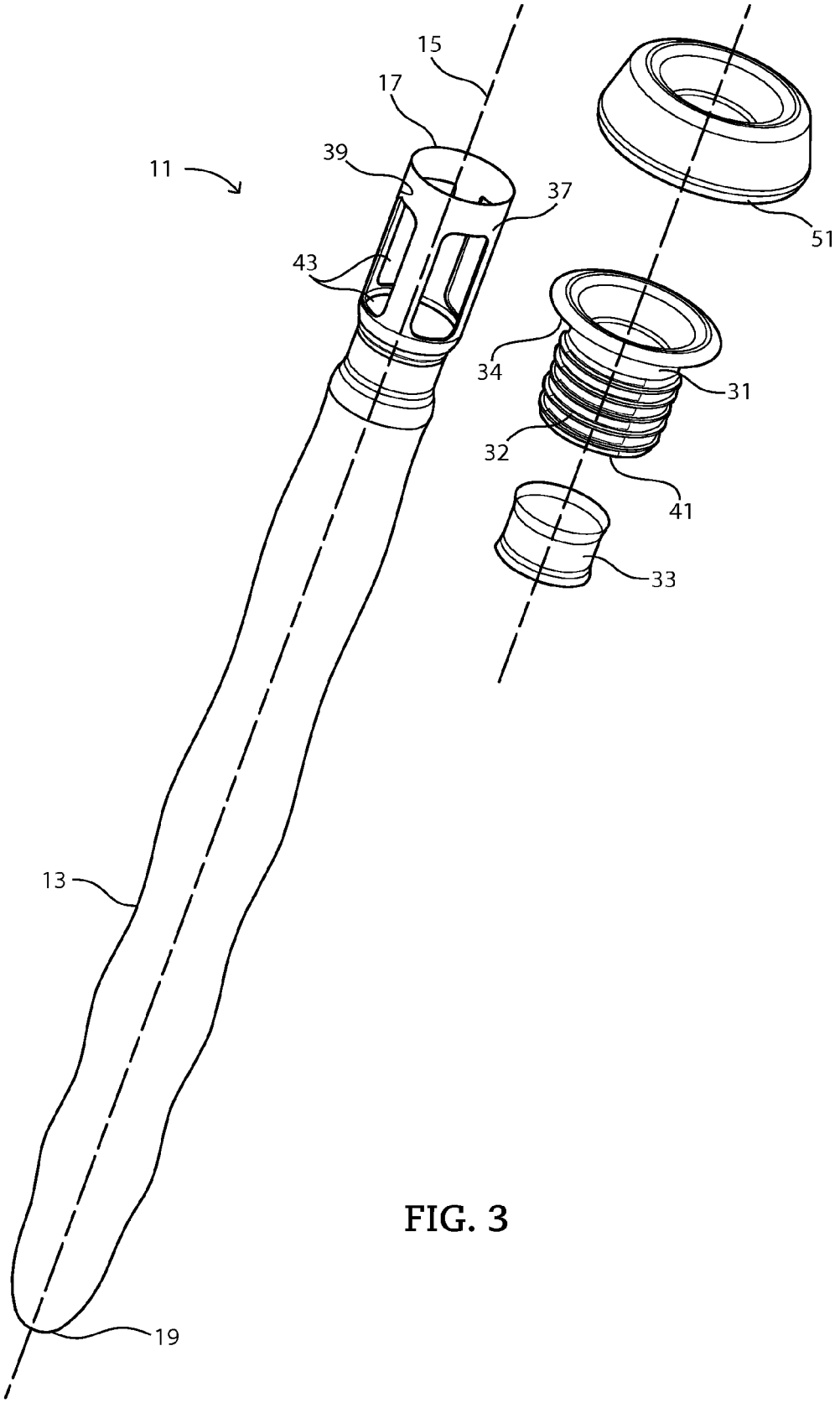
FIG. 3 is an exploded isometric view of an embodiment of the apparatus.

A cavity 21 is located inside the body 13. At manufacture, the cavity 21 is originally open on the proximal end 17, closed on the distal end 19, and has an elongated, generally tapered shape along an axial length of the body 13. A fluid 23 is located in the cavity 21 and may be sealed in the cavity 21 with a plug 33 (FIG. 3). The fluid 23 may have a freezing point of about 10° C. or less, such as about 0° C. or less. For example, the freezing point of the fluid 23 may be in a range of −1° C. to −30° C.

Embodiments of the fluid 23 may comprise a liquid or gel having a high potential heat value and a high specific heat capacity. The fluid has good water retention properties and is reusable. The fluid is non-toxic, non-polluting and a non-irritant to human contact. The fluid may comprise water and additives that cause the water to remain a thick gel throughout use, instead of transitioning between a solid and a free-flowing liquid like ordinary water. Such a gel may be formed from non-toxic materials that will not liquefy, and therefore will not spill easily or cause contamination if the container breaks. For example, the gel may be made by adding hydroxyethyl cellulose (e.g., cellusize) or vinyl-coated silica gel to water.

When apparatus 11 is chilled or frozen, fluid 23 helps maintain or regulate a temperature of a liquid, such as beer 25 in a bottle 27. See, e.g., FIG. 4. In some embodiments a seal or seal assembly, such as a stopper 31 (e.g., a gasket, ring, plunger, cork, etc.), may be mounted to the proximal end 17 of the body 13. Stopper 31 may be adapted to slidingly and temporarily engage and seal the bottle 27 of beer 25. However, embodiments of stopper 31 are retained by bottle 27 in a manner sufficient to prevent the accidental and/or premature removal of apparatus 11 from bottle 27.

As described herein, this design also permits fluid to flow from the bottle through the apparatus with the body still located inside of the bottle in contact with the fluid. The stopper may comprise natural or synthetic materials such as those known in the art. For example, a synthetic cork may be formed from a high quality, food grade thermoplastic elastomer, a wood material bonded by a bond material or resin, etc. The seal or stopper also provides structural support during the freezing and thawing cycles experienced during operational use, which better accommodates for expansion and contraction of materials to help prevent layered or laminated designs from failing.

In some embodiments, at least some of the components of apparatus 11 may be joined by conventional techniques, such as spin or ultrasonic welding, such that they are permanently joined to each other. Adhesives also may be used to join the components. Some embodiments of the body may be sealed to retain the fluid, or a closure of the cavity may be bonded, crimped, welded, etc., to permanently enclose the fluid. The seal may be attached to the body to provide a sliding interface surface for temporarily closing a container of fluid.

Figure 2:
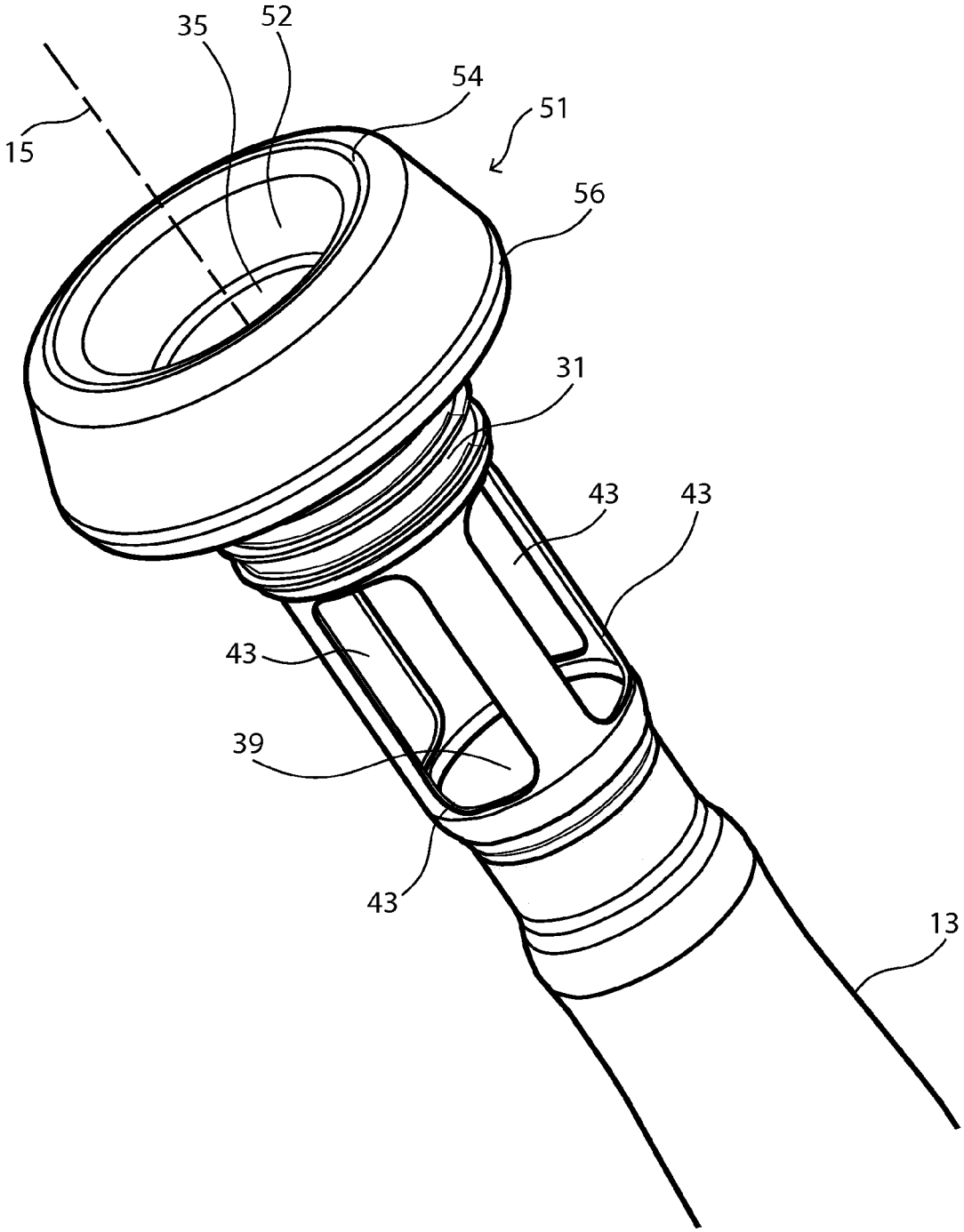

Embodiments of the body 13 may have only one cavity 21, only one fluid 23, and be non-cylindrical. The body 13 may have an opening 35 (FIG. 2) on the proximal end 17. Both the exterior surface of the body 13 and the interior surface of the cavity 21 may be generally tapered along their substantially entire axial lengths. Tapering of the cavity 21 may facilitate progressive freezing of the fluid from the distal end 19 toward the proximal end 17, and thereby the desired expansion of the fluid 23 as the fluid freezes solid. Such progressive freezing helps maintain the integrity of the body, even after numerous freezing/thawing cycles and uses, without leakage or rupture of the body. In some embodiments, the volume of fluid 23 contained within cavity 21 is sufficient so as to not be visible from an exterior of body 13 when held or stored upright with the stopper 31 at the top.

As shown in FIG. 1, the proximal end 17 of the body 13 may comprise a tube 37 extending axially from the body 13. The tube 37 may have a tube diameter ($d_t$) that is smaller than a proximal diameter ($d_p$) of the body. The stopper 31 may be mounted to the tube 37 via a through-hole 41 (FIG. 3) for receiving the tube 37. The through hole 41 is complementary in shape to the tube 37. At least a portion of an outer surface of the body 13 may be undulated.

In some embodiments, the body 13 is shaped in the form of an icicle, and may vary in axial sectional shape along a substantially entire axial length thereof. The body 13 may have an exterior surface that undulates axially, radially and/or circumferentially. As a result, some examples of the undulated body have an axial cross-sectional shape that varies continuously to the distal end 19. Such a configuration mimics naturally formed icicles. Such designs also increase the surface area of the body, thereby increasing its wine temperature maintenance performance. In other versions, the body has only a slight overall taper (e.g., like a carrot), rather than the icicle form. In still other versions, the body may be tapered with facets to appear crystalline in form, or may be cylindrical in shape.

In other examples, the body 13 may be provided with a proximal diameter ($d_p$) that defines a maximum diameter of the body, a distal diameter at the distal end ($d_d$) that defines a minimum diameter of the body, a first intermediate diameter ($d_1$) located between $d_p$ and $d_d$ that is smaller than $d_p$, and a second intermediate diameter ($d_2$) located between $d_1$ and $d_d$ that is larger than $d_1$. This pattern may be repeated. For example, a third intermediate diameter ($d_3$) may be smaller than $d_2$ but located between $d_2$ and $d_d$. A fourth intermediate diameter ($d_4$) may be larger than $d_3$, but located between $d_3$ and $d_d$. The interior surface of the cavity may mimic the profile or contour of the exterior of the body, such that the interior and exterior surfaces of the body are complementary in shape.

For example, the body may have a maximum outer diameter of about 15 mm to about 18 mm, the body may have a wall thickness of about 0.5 to about 1 mm, and the apparatus may have an overall length of about 270 mm to about 300 mm. In other embodiments, the body may have a maximum outer diameter of about 10 mm to about 20 mm, the body may have a wall thickness of about 0.5 to about 1 mm, and the apparatus may have an overall length of about 100 mm to about 300 mm. These dimensions may be varied to accommodate containers or bottles having different sizes.

Embodiments of the apparatus 11 also may comprise a device for regulating a temperature of a fluid inside a container, and dispensing the fluid from the container. The apparatus 11 may comprise a body 13 having an axis 15, a cavity 21 adjacent a distal end 19, a bore 39 adjacent a proximal end 17, and one or more fluid inlets 43 formed through the body 13 to the bore 39. The body 13 may be adapted to contact the fluid 25 inside the container 27.

A second fluid 23 may be located and sealed inside the cavity 21. The second fluid 23 may have a freezing point of about 10° C. or less. A nozzle 51 may be mounted to the body 13. The nozzle 51 may have a channel 52 in communication with the fluid inlet 43 through which the fluid 25 is adapted to flow out of the container 27 through the nozzle 51. A seal 31 may be mounted to the body 13. The seal 31 may comprise a radial seal 32 adapted to seal radially between the body 13 and an interior of the container 27, and an axial seal 34 adapted to seal axially between the nozzle 51 and a mouth of the container 27, such as sliding, temporary seal. The radial seal 32 may be mounted to the neck 37 of the body 13 proximate to the fluid inlet 43. The nozzle 51 may be shaped for direct consumption of the fluid by a mouth of a user, such that the apparatus 11 is a drink-through device, and not simply a pour-through device. The channel 52 may be attached to the proximal end 17 of the body 13, such as by bond, weld, threads, etc.

Figure 5:
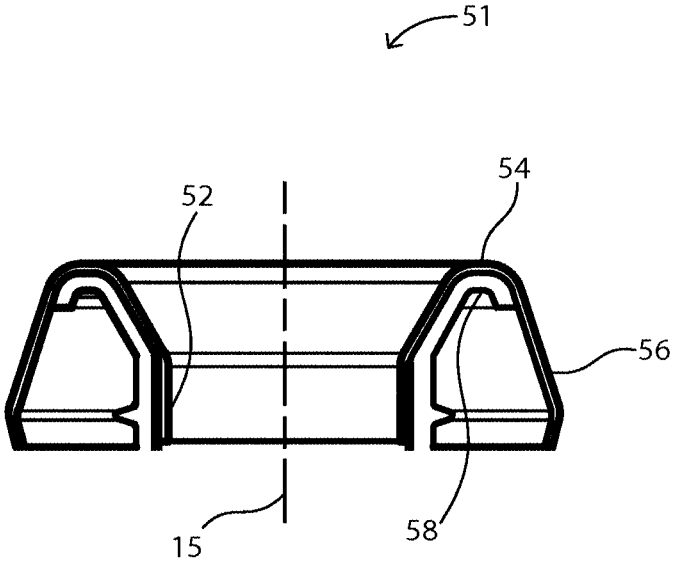
FIG. 5 is a side view of an embodiment of an apparatus in operation.

Embodiments of the nozzle 51 may be provided with a proximal end 54 that is substantially flat and perpendicular with respect to the axis 15. A wall 56 that is generally semi-spherical may extend distally from the proximal end 54. The channel 52 may be substantially concentric with the proximal end 54 and wall 56 of the nozzle 51. The axial seal 34 may abut an interior surface 58 (FIG. 5) of the proximal end 54 of the nozzle 51. An axial length of the wall 56 of the nozzle 51 may be greater than an axial length of the channel 52 of the nozzle 51, as shown in FIG. 5.

In some embodiments, the seal 31 may comprise a third seal (not shown) extending from the axial seal 34. The third seal may have a diameter that is larger than a diameter of an opening of the container 27. The third seal may be adapted to seal between an exterior of the opening of the container 27 and an interior of a wall 56 of the nozzle 51.

The apparatus 11 may further comprise a ring 61 mounted to the body 13 axially distal to the fluid inlet 43. The ring 61 may comprise an identifier, such as a logo ring. The ring 61 may be mounted to the tube or neck 37 of the body 13 between the fluid inlet 43 and the undulated body 13. The body 13 may have a tube or neck 37 that is straight and cylindrical. The neck 37 may have a diameter that is smaller than a diameter of the undulated body 13. The undulated body 13 may be provided with a series of radial bulges (FIG. 1) that are axially spaced-apart from each other.

Embodiments of the apparatus 11 may not comprise a cap, a plug or closure of any kind for the nozzle 51, such that the channel 52 of the nozzle 51 is completely unobstructed for fluid flow from the container 27. The fluid inlet 43 may comprise a plurality of fluid inlets 43 formed in the body 13 in a symmetrical pattern. The nozzle 51 may have an axial length that is less than an axial length of the seal 31, such as the radial seal 32. In alternative embodiments, the fluid inlet 43 may be formed in the nozzle 51 (not shown) rather than the body 13, such that the nozzle 51 has an axial length that is greater than an axial length of the seal 31. The seal 31 may be bonded to the body 13. A plug 33 may be used to permanently seal the second fluid 23 in the cavity 21.

The apparatus 11 may be axially symmetrical. The body 13 may be formed from a metallic material. The body 13 may be tapered along a substantially entire axial length thereof. The seal 31 may be is adapted to slidingly and temporarily engage an opening in the container 27.

Other embodiments of an apparatus for regulating a temperature of fluid in a container may comprise a body having an axis, a proximal end, a distal end, a cavity inside the body, an elongated shape in an axial direction, and a series of radial bulges axially spaced apart from each other. A fluid may be sealed in the cavity and having a freezing point below about 10° C. An assembly (e.g., 31 and 51, collectively) may be mounted adjacent the proximal end of the body. The assembly may have a radial seal adapted to seal an opening in the container of fluid, and a channel that is completely unobstructed without a closure and adapted to dispense fluid therethrough from the container.

Still other embodiments of an apparatus for regulating a temperature of a fluid in a bottle may comprise a body having an axis, a proximal end, a distal end, a cavity inside the body, the body being elongated in an axial direction such that an exterior of the body is generally tapered axially for a substantially entire axial length thereof. A fluid may be sealed in the cavity and have a freezing point below about 10° C. An assembly may be mounted adjacent the proximal end of the body. An exterior of the assembly may be adapted to seal the bottle of fluid, and an interior of the assembly is adapted to dispense fluid therethrough, such as without an aerator so that the fluid may not be aerated.

Figure 4:
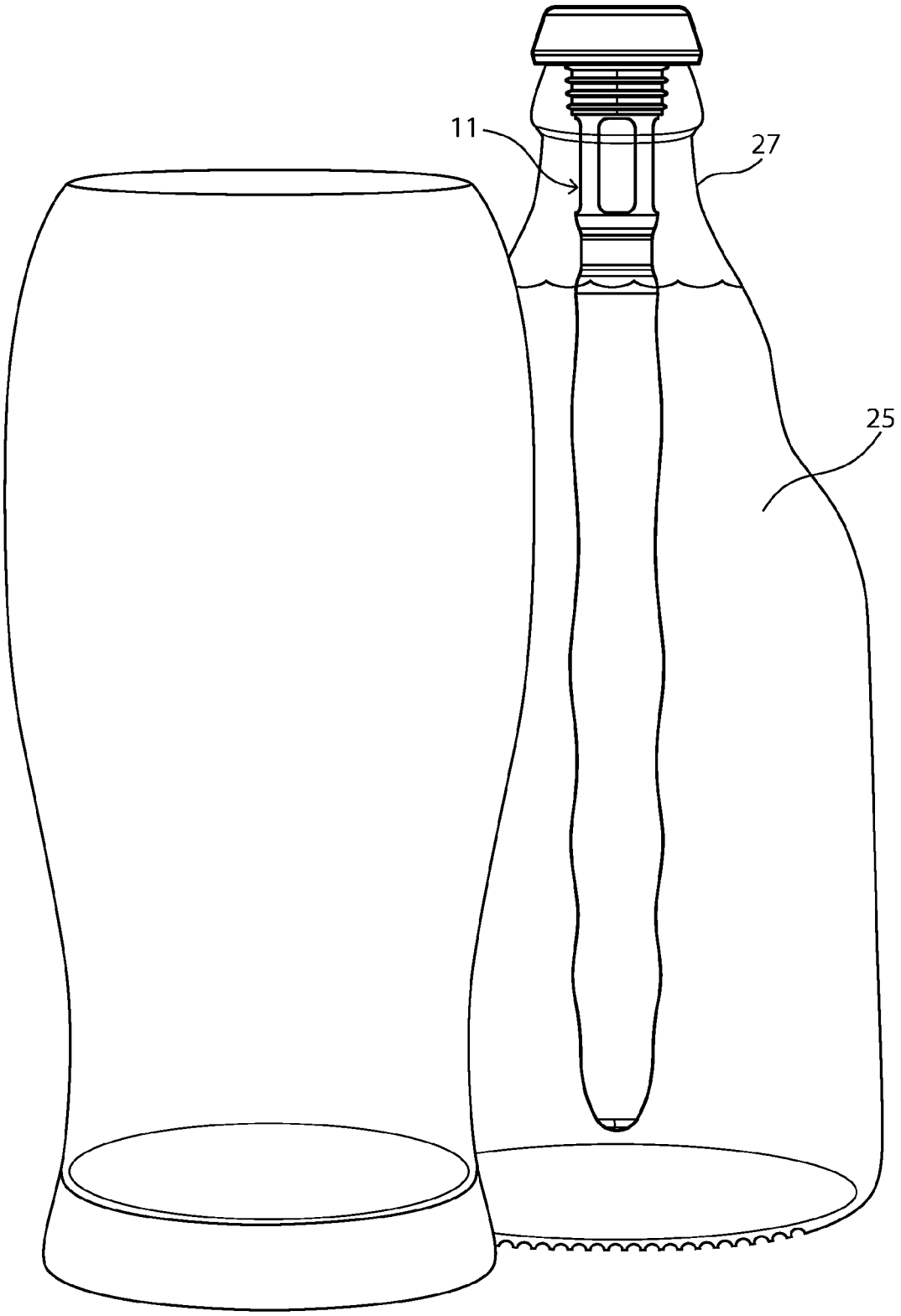
FIG. 4 is a sectional side view of a portion of an embodiment of an apparatus.

In operation, apparatus 11 may be chilled or frozen by placing it in a freezer. When a user wishes to maintain or regulate the temperature of a fluid 25 in a container 27, the apparatus 11 may be removed from the freezer and placed in the container 27 through an opening in the container 27 such that body 13 is in contact with the fluid 25 in the container 27. For example, as shown in FIG. 4, the apparatus 11 may be inserted into a bottle 27 of beer 25 to help regulate or maintain the beer 25 at a proper serving temperature for a longer period of time. Any of the embodiments described herein may be used in a similar manner. The apparatus 11 forms a sliding, temporary seal inside the bottle 27. When beer 25 is poured, the apparatus 11 remains securely sealed in the bottle 27, and the beer 25 is poured through apparatus 11 as described herein. The nozzle 41 of apparatus 11 also permits it to be a direct drink-through device, not just a pour-through device.

Other applications include uses that do not involve beverages, such as commercial or laboratory cooling or temperature regulation of fluids in containers, wherein the stopper may not necessarily be required to slidingly engage and seal the opening of the container. For example, some containers have top openings that are much larger in diameter than the diameter of the stopper. The numerous features, elements and materials described for the various embodiments disclosed herein may be used in the other embodiments as well.

In still other embodiments, an apparatus for regulating a temperature of a fluid in a bottle may comprise a body having an axis, a proximal end, a distal end, and a cavity inside the body. The body may be elongated in an axial direction such that an exterior of the body is generally tapered axially for a substantially entire axial length thereof. A fluid may be sealed in the cavity and having a freezing point below about 10° C. An assembly may be mounted adjacent the proximal end of the body. An exterior of the assembly may be adapted to seal the bottle of fluid. An interior of the assembly may be adapted to dispense fluid therethrough. The exterior of the assembly may be frusto-conically tapered.

Embodiments of the body may have a radial wall thickness at the bore (Rb), and the body has a radial wall thickness at the cavity (Rc) that is less than Rb by at least about 10%, at least about 20%, or at least about 30% (e.g., about 32%). The Rc may vary along the cavity in the axial direction. The cavity may comprise radially wide portions (e.g., bulges) and radially narrow portions (e.g., narrower neck sections that are smaller than the bulges), with respect to the axis. The Rc may be greater in the radially narrow portions and the Rc may be less in the radially narrow portions. In addition, the body may comprise a stainless steel and copper alloy, such as 304 stainless steel, and at least about 5% copper, and/or no more than about 15% copper (e.g., about 8% to about 10%).

This written description uses examples to disclose the embodiments, including the best mode, and also to enable those of ordinary skill in the art to make and use the invention. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Note that not all of the activities described above in the general description or the examples are required, that a portion of a specific activity may not be required, and that one or more further activities may be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

What is claimed is:

1. An apparatus for regulating a temperature of a fluid inside a container, and dispensing the fluid from the container, comprising:

a body having an axis, a cavity adjacent a distal end, a bore adjacent a proximal end, a fluid inlet formed through the body to the bore, and the body is adapted to contact the fluid inside the container;

a second fluid located and sealed inside the cavity, the second fluid having a freezing point of about 0° C. or less;

a nozzle mounted to the body, the nozzle having a channel in communication with the fluid inlet through which the fluid is adapted to flow out of the container through the nozzle; and a seal mounted to the body, the seal having a radial seal adapted to seal radially between the body and an interior of the container, and an axial seal adapted to seal axially between the nozzle and the container.

2. The apparatus of claim 1, wherein the nozzle has a proximal end that is substantially flat and perpendicular with respect to the axis, a wall that is generally semispherical extending distally from the proximal end, and the channel is substantially concentric with the proximal end and wall of the nozzle.

3. The apparatus of claim 1, wherein the seal comprises a third seal extending from the axial seal, the third seal having a diameter that is larger than a diameter of an opening of the container, the third seal is adapted to seal between an exterior of the opening of the container and an interior of a wall of the nozzle.

4. The apparatus of claim 1, wherein at least a portion of an outer surface of the body is undulated.

5. The apparatus of claim 1, wherein the body has a neck that is straight and cylindrical, and the neck has a diameter that is smaller than a diameter of the body.

6. The apparatus of claim 1, wherein the apparatus does not comprise a cap, a plug or closure of any kind for the nozzle, such that the channel of the nozzle is completely unobstructed for fluid flow from the container.

7. The apparatus of claim 1, wherein the body has a radial wall thickness at the bore (Rb), and the body has a radial wall thickness at the cavity (Rc) that is less than (Rb) by at least about 10%.

8. An apparatus for regulating a temperature of fluid in a container, comprising:

a body having an axis, a proximal end, a distal end, a cavity inside the body, an elongated shape in an axial direction, and a series of radial bulges axially spaced apart from each other;

a fluid sealed in the cavity and having a freezing point below about 10° C.; and an assembly mounted adjacent the proximal end of the body, the assembly having a radial seal adapted to seal an opening in the container of fluid, a channel that has no closure and is completely unobstructed and adapted to dispense fluid therethrough from the container, and a seal having a radial seal adapted to seal radially between the body and an interior of the container to form a sliding and temporary seal with an interior of the container, and the radial seal is axially spaced apart from the fluid inlet.

9. The apparatus of claim 8, wherein the assembly comprises a nozzle mounted to the body, the nozzle having the channel in communication with the fluid inlet through which the fluid is adapted to flow out of the container through the nozzle.

10. The apparatus of claim 8, wherein the seal comprises an axial seal adapted to seal axially between the nozzle and the container.

11. The apparatus of claim 8, wherein the nozzle has a proximal end that is substantially flat and perpendicular with respect to the axis, a wall that is generally semispherical extending distally from the proximal end, and the channel is substantially concentric with the proximal end and wall of the nozzle.

12. The apparatus of claim 8, wherein the seal comprises a third seal extending from the axial seal, the third seal having a diameter that is larger than a diameter of an opening of the container, the third seal is adapted to seal between an exterior of the opening of the container and an interior of a wall of the nozzle.

13. The apparatus of claim 8, wherein the body has a neck that is straight and cylindrical, and the neck has a diameter that is smaller than a diameter of the body.

14. The apparatus of claim 8, wherein the body has a radial wall thickness at the bore (Rb), and the body has a radial wall thickness at the cavity (Rc) that is less than (Rb) by at least about 10%.

15. An apparatus for regulating a temperature of a fluid in a bottle, comprising:

a body having an axis, a proximal end, a distal end, a cavity inside the body, the body being elongated in an axial direction such that an exterior of the body is generally tapered axially for a substantially entire axial length thereof;

a fluid sealed in the cavity and having a freezing point below about 0° C.; and an assembly mounted adjacent the proximal end of the body, an exterior of the assembly is adapted to seal the bottle of fluid, an interior of the assembly is adapted to dispense fluid therethrough without an aerator, and a seal adapted to form a sliding and temporary seal with an interior of the container; and wherein the seal is mounted to the body, the seal having a radial seal adapted to seal radially between the body and the interior of the container, and an axial seal adapted to seal axially between the nozzle and the container.

16. The apparatus of claim 15, wherein the assembly comprises a nozzle mounted to the body, the nozzle having a channel in communication with the fluid inlet through which the fluid is adapted to flow out of the container through the nozzle.

17. The apparatus of claim 15, wherein the nozzle has a proximal end that is substantially flat and perpendicular with respect to the axis, a wall that is generally semispherical extending distally from the proximal end, and the channel is substantially concentric with the proximal end and wall of the nozzle.

18. The apparatus of claim 15, wherein the seal comprises a third seal extending from the axial seal, the third seal having a diameter that is larger than a diameter of an opening of the container, the third seal is adapted to seal between an exterior of the opening of the container and an interior of a wall of the nozzle.

19. The apparatus of claim 15, wherein the body has a neck that is straight and cylindrical, and the neck has a diameter that is smaller than a diameter of the body; and the body has a radial wall thickness at the bore (Rb), and the body has a radial wall thickness at the cavity (Rc) that is less than (Rb) by at least about 10%.

* * * * *